US006789932B2

(12) United States Patent
Healy

(10) Patent No.: US 6,789,932 B2
(45) Date of Patent: Sep. 14, 2004

(54) ILLUMINATED CARRIER EMPLOYING FIBER OPTICS

(76) Inventor: Dennis Healy, 8849 SE. Jannsen Rd., Clackamas, OR (US) 97015

( * ) Notice: Subject to any disclaimer, the term of this patent is extended or adjusted under 35 U.S.C. 154(b) by 0 days.

(21) Appl. No.: 10/098,812

(22) Filed: Mar. 14, 2002

(65) Prior Publication Data

US 2003/0174519 A1 Sep. 18, 2003

(51) Int. Cl.[7] ..... A47G 35/00

(52) U.S. Cl. ..... 362/565; 362/154; 362/808; 362/234

(58) Field of Search ..... 362/154, 156, 362/555, 554, 565, 566, 806, 109, 234, 252; 446/484, 485

(56) References Cited

U.S. PATENT DOCUMENTS 4,698,732 A 10/1987 Hickey
4,926,296 A * 5/1990 Blume et al. ..... 362/156
5,879,071 A * 3/1999 Sanford, Jr. ..... 362/154
5,984,754 A 11/1999 Freelander
6,059,423 A * 5/2000 Knopick ..... 362/156
6,145,553 A 11/2000 Sofy
6,200,000 B1 3/2001 Burnidge
6,217,188 B1 * 4/2001 Wainwright et al. ..... 362/103

* cited by examiner

*Primary Examiner*—Alan Cariaso
*Assistant Examiner*—Ali Alavi
(74) *Attorney, Agent, or Firm*—Dellett & Walters

(57) ABSTRACT

A decorative carrier for Halloween candy and the like employs fiber optic members to carry and emit light to the exterior surface of the carrier. Additional light sources may be positioned about the carrier, and flashing or non-flashing lighting is provided. An audible emission may also be provided.

27 Claims, 3 Drawing Sheets

ILLUMINATED CARRIER EMPLOYING FIBER OPTICS

BACKGROUND OF THE INVENTION

This invention relates to carriers for items, such as for Halloween candy or the like, and more particularly for a carrier having decorative lights thereon that also provide a safety function.

Candy gathered by children at Halloween is typically carried in some type of receiving vessel, such as a bag or small bucket.

However, it would be desirable to have a candy carrying vessel that provides both safety illumination, to make the trick-or-treater more visible to oncoming vehicles, and which also provides a decorative feature.

SUMMARY OF THE INVENTION

In accordance with the invention, a vessel is provided with one or more light sources and optical fibers that distribute the light to one or more locations for viewing.

Accordingly, it is an object of the present invention to provide an improved carrying vessel having fiber optic lighting features.

It is a further object of the present invention to provide an improved candy carrying container with safety lighting visible from the exterior thereof employing fiber optic features.

It is yet another object of the present invention to provide an improved Halloween carrying container having plural fiber optic members for safety illumination and for providing an aesthetic appearance.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The device according to a preferred embodiment of the present invention comprises a carrying bucket for use as a Halloween candy carrier, for example, having light sources therein and fiber optic members to distribute the light.

Figure 1:
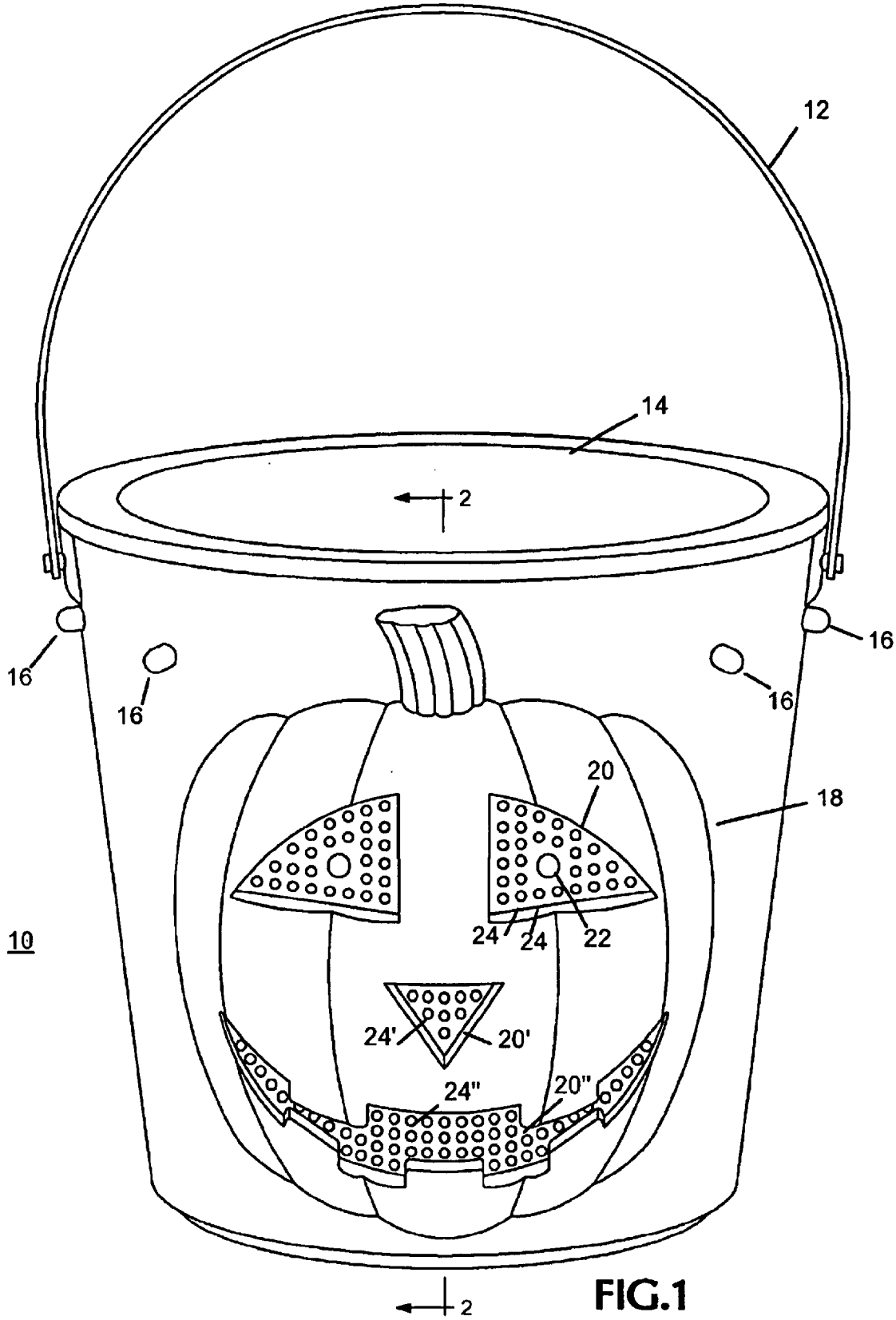
FIG. 1 is a perspective view of an illuminated carrier in accordance with an embodiment of the invention.

Referring now to FIG. 1, a perspective view of an illuminated carrier in accordance with a first embodiment of the invention, the carrier is in the form of a bucket 10 having a bail type carrying handle 12 attached in a swiveling fashion to the bucket. The interior 14 of the bucket defines a receiving cavity to hold items, suitably candy in the case of a Halloween carrying vessel.

Light sources 16, suitably comprising light emitting diodes, in a preferred embodiment, are spaced somewhat regularly about the outer face of the bucket, positioned approximately one to two inches below the upper lip of the bucket. In a particular preferred configuration, there are seven such light sources 16, spaced at 45 degrees apart. There is no light source provided in the illustrated embodiment where an eighth light would be, so two of the lights are spaced 90 degrees apart relative to each other.

At the position radially about the bucket where an eighth light would be, in the illustrated embodiment of FIG. 1, a decorative face 18 is mounted to the outer face of the bucket. In FIG. 1, the face comprises a jack-o-lantern representation, having eye openings 20, nose openings 20' and mouth openings 20". Somewhat centered in the eye areas are light sources 22, again suitably comprising light emitting diodes. Plural smaller light sources 24 are somewhat regularly distributed in the eye regions (and the nose and mouth regions).

Figure 2:
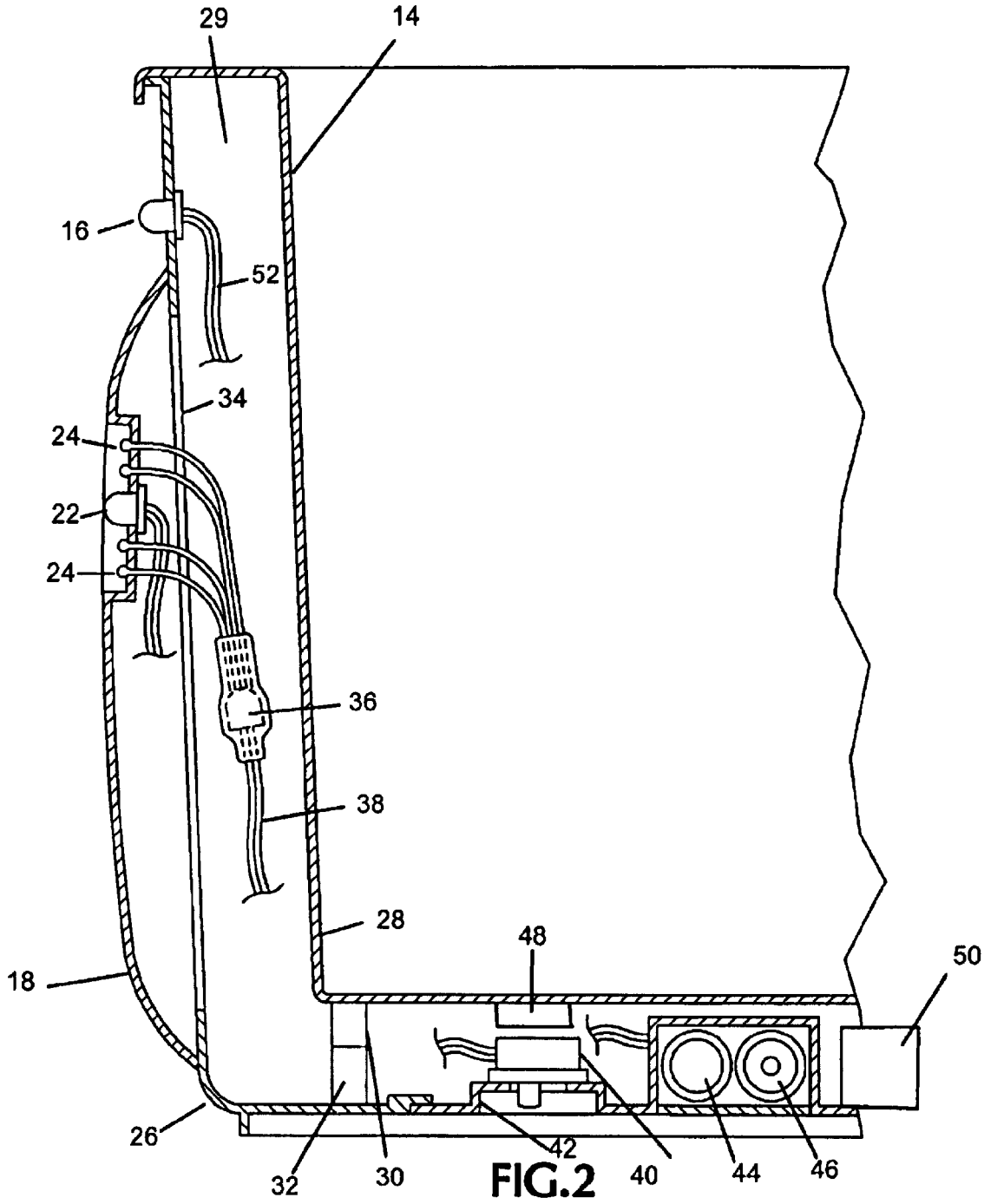
FIG. 2 is a sectional view of the carrier of FIG. 1 taken along line 2—2.

Referring now to FIG. 2, which is a sectional view of the carrier taken along line 2—2 of FIG. 1, it may be observed that the bucket 10 comprises an outer shell 26 and an inner shell 28 which define a space 29 therebetween. Spacers 30 and 32 on the respective bucket portions meet to maintain the inner and outer portions in spaced relation. Suitably, fasteners in the form of a screw or the like, hold the buckets portions together after assembly. In that defined space 29, the wiring and such components are contained that result in the light sources emitting light. Preferably, light sources 24 comprise fiber optic members which extend through plural openings in the face portion, inwardly to the space 29 via an opening 34 in the outer shell. Inside that space, plural ones of the fiber optic members are brought together and are exposed to an internal light emitting source 36, again suitably comprising a light emitting diode. The light emitting diode 36 is connected via wires 38 to a switch 40 which is mounted so the control thereof is accessible to the outside of the bucket in a recessed portion 42 thereof, defined in the bottom of the bucket in the illustrated embodiment.

Batteries 44 and 46 suitably provide power via the switch to the light source 36 (and to the light sources 16 and 22, also). The switch preferable has 3 positions, and an intermittent flash circuit 48 so that in one position the switch is off, in a second position the light sources are powered in continuous fashion, and in the switch position, the flash circuit is engaged so that, in the preferred embodiment, light sources 22 (representing the eyes in the case of the jack-o-lantern) will flash on and off.

As a result of the plural fiber optic members, a field of discrete light sources is defined and visible on the outside of the bucket at each location where a fiber optic member appears. By selection of different colors for the light sources 16, 22 and 36, combinations of colors may be obtained. For example, in a particular embodiment, sources 16 and 36 are suitably red, while source 22 are green, resulting in the appearance of green pupils (which may or may not be flashing) surrounded by a red background.

For clarity of illustration, the number of fiber optic members has been reduced from what is actually employed in an actual embodiment. A given single eye opening 20 may have more than 40 fiber optic members visible, for example.

Also shown in FIG. 2, is an exemplary mounting configuration of a light source 16. It is shown here shifted radially from an actual position, for ease of illustration.

Light source 16 is powered by batteries 44, 46 via switch 40. In the preferred embodiment, the light sources 16 are configured to not be powered through flasher 48, so whenever switch 40 is in an on position, light sources 16 will be continuously illuminated. However, if desired, the device may be configured so that light sources 16 would flash as do light sources 22. Also, light sources 22 can be made to not flash, or to be steadily illuminated if light sources 16 are flashing. Still further, the light source illuminating the fiber optic members can also be configured to flash or not. By employing a multiple position switch, various configurations of flashing or not can be accomplished.

An audio source 50 may also be provided in the base of the bucket, openings being provided therein if desired to enhance the volume of sound escaping therefrom. The sound generated may be thematically coupled with the decorative portion 18 of the bucket, "spooky" sounds being employed in the case of a Halloween theme. Again, the audio can suitably be turned on or off either together with the lights or separately therefrom.

While single color light sources are shown in the preferred embodiment, multi-color light emitting diodes may be employed, for example, tri-color LEDs. Thus, a color changing light source can be used if desired.

Figure 5:
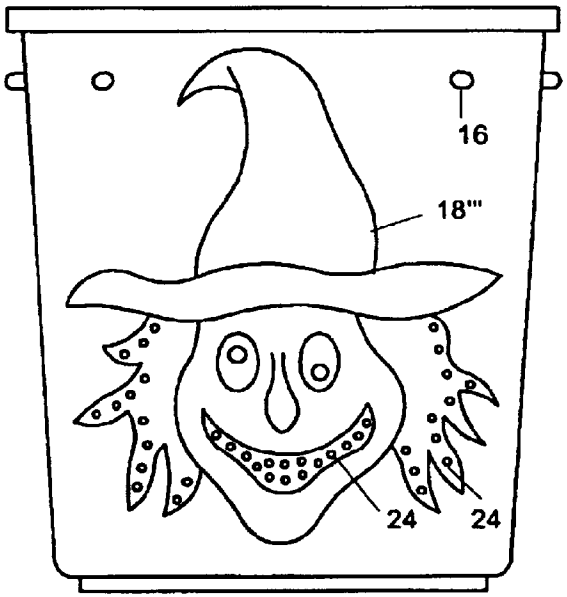
FIG. 5 is a view of a carrier employing a third alternate decorative face thereon.
Figure 4:
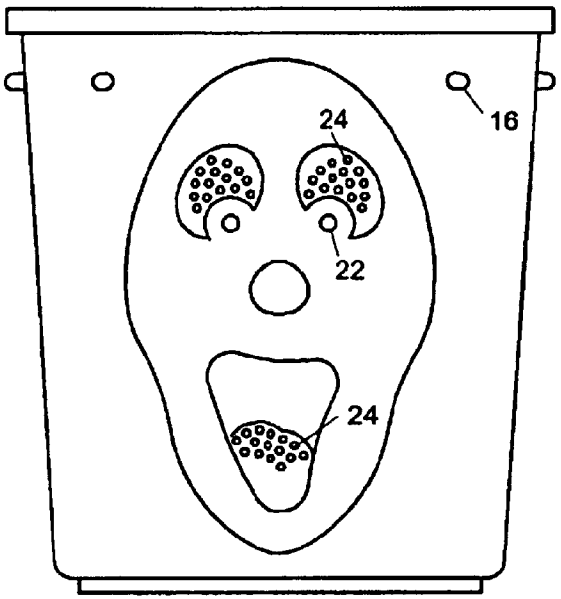
FIG. 4 is a view of a carrier employing a second alternate decorative face thereon.
Figure 3:
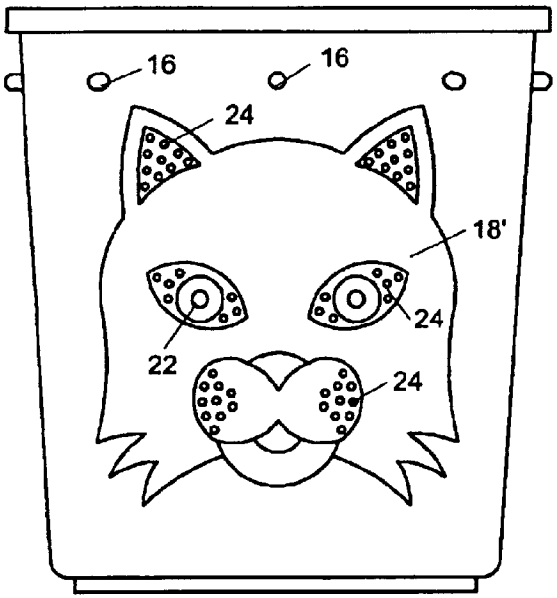
FIG. 3 is a view of a carrier employing a first alternate decorative face thereon.

FIG. 3, FIG. 4 and FIG. 5 illustrate exemplary alternative face members 18, FIG. 3 comprising a cat face 18', FIG. 4 being a ghost or ghoul face 18", and FIG. 5 being a witch face 18'''. Each of these employs corresponding light sources 16, 22 and optical fiber members 24. It may be observed that the placement and configuration of the optical fibers may be varied to conform to the details of the face member.

Thus, the smaller light sources preferably comprise the emitting ends of fiber optic members, which have their opposite ends positioned to receive light therein from a light source in the interior of the bucket.

Therefore, according to the invention, a decorative and safety enhanced carrier is provided, having fiber optic members to provide an enhanced appearance and functionality to the carrier. Other light sources are also suitably employable, and configurations of flashing or not flashing and sound generation or no sound generation may be employed.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A decorative carrier comprising:

a substantially rigid outer shell portion;

a substantially rigid inner shell portion positioned within said outer shell portion, defining a space therebetween;

a light source positioned within the space defined between said shell portions;

at least one fiber optic member carrying light from the light source to an exterior surface of the outer shell portion for enabling the light to be visible to the exterior, further comprising plural other light sources positioned radially about the outer shell portion.

2. The decorative carrier according to claim 1, wherein said at least one fiber optic member comprises plural fiber optic members.

3. The decorative carrier according to claim 1, wherein said first mentioned light source comprises a light emitting diode.

4. The decorative carrier according to claim 1, further comprising a decorative member to provide the decorative aspects to said carrier.

5. The decorative carrier according to claim 4, wherein said decorative member comprises a jack-o-lantern face.

6. The decorative carrier according to claim 4, wherein said decorative member comprises a representation of at least a portion of a cat.

7. The decorative carrier according to claim 4, wherein said decorative member comprises a representation of at least a portion of a witch.

8. The decorative carrier according to claim 4, wherein said decorative member comprises a representation of a ghost.

9. The decorative carrier according to claim 4, wherein said decorative member comprises a representation of a ghoul.

10. The decorative carrier according to claim 1, further comprising a flash generator for causing at least one of said plural other light sources to flash.

11. The decorative carrier according to claim 1, wherein at least one of said plural other light sources positioned radially about a portion of the carrier comprises a light emitting diode.

12. A Halloween candy carrier, comprising:

plural first light sources positioned radially about a portion of the carrier;

plural fiber optic members carrying light from at least one second light source, to an exterior surface of the carrier for enabling the light to be visible to the exterior;

at least one third source, wherein said at least one third light source is disposed in a position and wherein plural ones of said plural optical fiber members are disposed in positions near said position where said at least one third light source is disposed.

13. The Halloween candy carrier according to claim 12, further comprising a flash generator for causing at least one of said first light sources to flash.

14. The Halloween candy carrier according to claim 12 wherein at least one of said light sources comprise light emitting diode.

15. The Halloween candy carrier according to claim 12 further comprising a decorative member to provide the decorative aspects to said carrier.

16. The Halloween candy carrier according to claim 15, wherein said decorative member comprises a jack-o-lantern face.

17. The Halloween candy carrier according to claim 16, wherein said third light source is disposed in an eye region of said jack-o-lantern face.

18. The Halloween candy carrier according to claim 16, wherein said third light source is disposed in an eye region of said cat.

19. The Halloween candy carrier according to claim 15, wherein said decorative member comprises a representation of at least a portion of a cat.

20. The Halloween candy carrier according to claim 19, wherein said third light source is disposed in an eye region of said witch.

21. The Halloween candy carrier according to claim 15, wherein said decorative member comprises a representation of at least a portion of a witch.

22. The Halloween candy carrier according to claim 21, wherein said third light source is disposed in an eye region of said ghost.

23. The Halloween candy carrier according to claim 21, wherein said third light source is disposed in an eye region of said ghoul.

24. The Halloween candy carrier according to claim 15, wherein said decorative member comprises a representation of a ghost.

25. The Halloween candy carrier according to claim 15, wherein said decorative member comprises a representation of a ghoul.

26. The decorative carrier according to claim 12, wherein at least one of said first and second light sources comprises a light emitting diode.

27. The Halloween candy carrier according to claim 12, wherein said carrier comprises a substantially rigid outer shell portion; and a substantially rigid inner shell portion positioned within said outer shell portion, defining a space therebetween, wherein said at least one second light source is positioned within the space defined between said shell portions.

* * * * *